United States Patent [19]

Lindsey

[11] Patent Number: 4,488,681

[45] Date of Patent: Dec. 18, 1984

[54] HEAT SAVING DEVICE

[76] Inventor: Donald A. Lindsey, Rte. 7, Box 7095-C, Nampa, Id. 83651

[21] Appl. No.: 505,850

[22] Filed: Jun. 20, 1983

[51] Int. Cl.[3] ..... F24B 7/00

[52] U.S. Cl. ..... 237/55; 126/99 D; 165/DIG. 2

[58] Field of Search ..... 237/55, 50; 165/DIG. 2, 165/DIG. 12; 126/110 R, 99 R, 99 D, 99 A, 110 D

[56] References Cited

U.S. PATENT DOCUMENTS 4,313,562 2/1982 White ..... 237/55

4,359,187 11/1982 Moore ..... 237/55

*Primary Examiner*—Henry Bennett

*Attorney, Agent, or Firm*—W. Boswell Childs

[57] ABSTRACT

A heat saving device is provided for use in connection with the flue pipe of a stove, furnace, or similar heater. Instead of being exhausted directly into the atmosphere through the flue pipe, hot exhaust gases and other combustion products pass through a heat transfer chamber. An open-ended tube forms the inside wall of the chamber so that heat from the gases and other combustion products passing through the chamber is transferred to the useful air flowing through the tube. A removable shroud open at one end and baffled at the other partially surrounds the outer wall of the heat transfer chamber in spaced relationship to the outer wall, permitting flow of useful air through the space thus formed. The useful air flowing through this space is preheated by heat transferred through the outer wall and subsequently entrained by and mixed with air being blown through the inner tube by a fan. The total volume of useful air heated in this manner is added to the heated air provided by direct heating action of the heater. A two-bladed scraper mechanism is included for removing residue from the inner and outer walls of the chamber through which the combustion products pass.

4 Claims, 5 Drawing Figures

FIG. 3
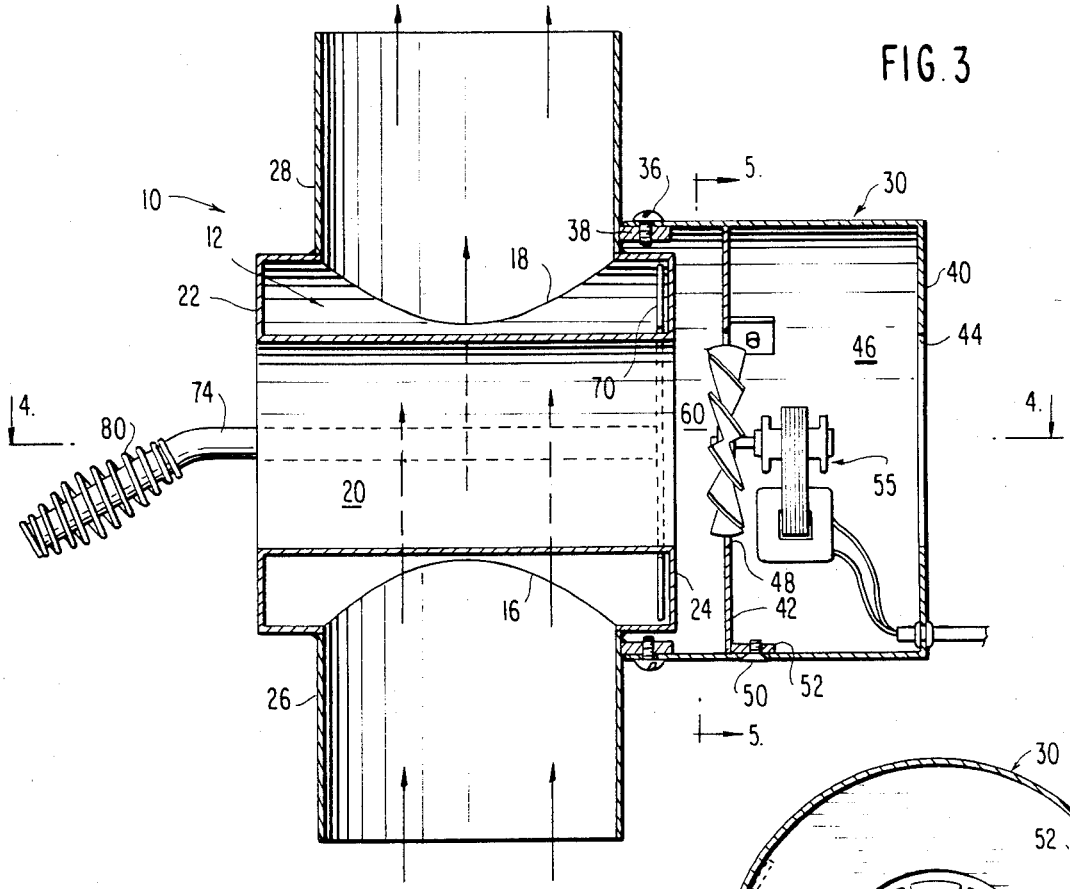
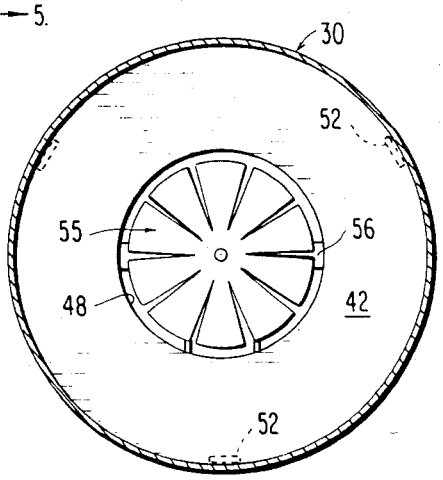
FIG. 5
FIG. 4
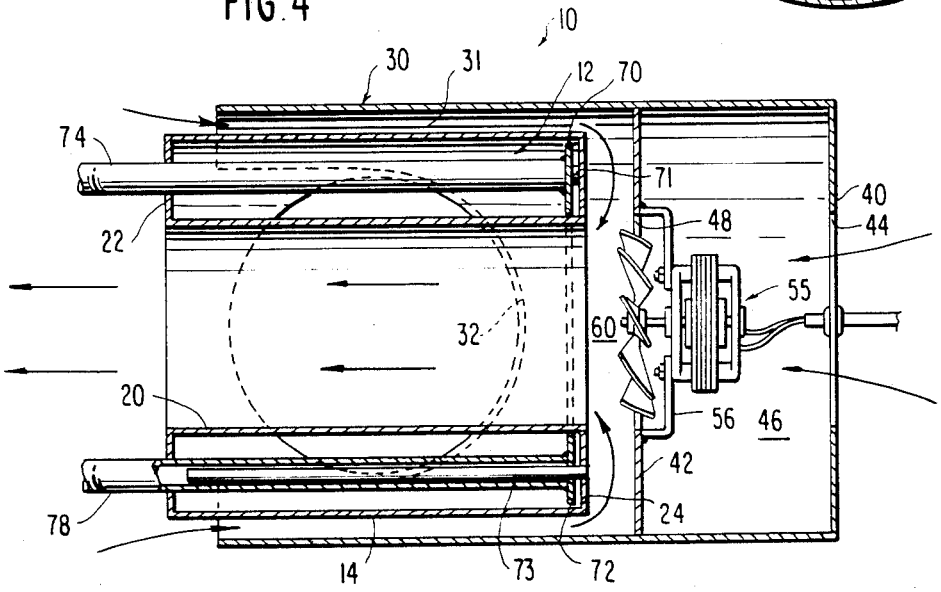

HEAT SAVING DEVICE

BACKGROUND

This invention relates to heat saving devices which are useful in connection with the flue pipe of a stove, furnace or similar heater.

Such devices have been known for some time, as is evidenced by U.S. Pat. Nos. 1,785,649 and 2,147,658. Inventive activity in this field has been renewed with recent emphasis on energy conservation as is shown by U.S. Pat. No. 4,313,562.

Devices of the type of the present invention function by scavenging the heat carried by exhaust gases and products of combustion, which normally pass through the flue pipe into the atmosphere. The heat accompanying the gases and combustion products would become wasted heat unless transferred to useful air. Useful air thus heated is then circulated into a room or space, adding substantially to the heat provided directly by the basic heater.

It is obviously important that such devices deliver a large volume of heated useful air. This requires the efficient transfer of heat from the exhaust gases and combustion products to useful air. Also necessary is the smooth and relatively unobstructed flow of both useful air and the exhaust gases and products from which heat is extracted for transfer to the useful air. The invention provides a compact and efficient device meeting these objects.

A single open-ended tube forms the inside of a chamber through which the hot exhaust gases and combustion products flow and provides for the smooth and unobstructed flow of a large volume of useful air in efficient heat transfer relationship with the hot exhaust gases and combustion products. The useful air is driven through the tube by a fan. Improved overall efficiency of heat transfer is attained by preheating some of the useful air flowing through the inside tube. This is made possible by a removable shroud positioned around the outside wall of the exhaust gas chamber in spaced relationship to the outside wall, leaving room for useful air to flow between the shroud and the outside wall of the chamber. Air flowing through this space is preheated and then is entrained and mixed with the useful air being blown directly into the inner tube. The resulting whole volume of useful heated air is added to the air directly heated by the stove or furnace. Importantly, means for cleaning residue from both the inside and outside walls of the exhaust gas chamber is included.

SUMMARY OF THE INVENTION

It is an object of the invention to provide an efficient and compact heat saving device for use with the flue pipe of a stove, furnace, or the like heater, thereby conserving energy. This is accomplished by providing a unique structure for transfer of heat from the exhaust gases and combustion products in the flue pipe to useful air which is then circulated in the space to be heated. The invention comprises a chamber for smooth flow therethrough of gases and combustion products intended for exhaust from the heater to the outside atmosphere, as through a flue pipe. Suitable inlet and outlet openings for the gases and combustion products are provided in the outer wall or shell of the chamber. These openings are provided with sleeve-like pipe sections for mating with the flue pipe or, alternatively, a flange or other fitting formed on the heater itself.

An open-ended tube forms the inside wall of the chamber. This tube is supported by the end walls of the exhaust gas chamber. As useful air is forced through the open-ended tube heat is transferred from the hot exhaust gases in the chamber to the useful air in the tube.

A removable shroud is designed to partially surround the exhaust gas chamber in spaced relationship to the outer wall of the chamber. The shroud is open at one end to permit useful air to enter and flow through the space formed between the outer wall of the exhaust gas chamber and the shroud, thereby transferring heat from the exhaust gases to this useful air.

The other end of the removable shroud has a baffled opening in line with the opening in the inner tube to direct movement of air into the tube opening. A second baffle, which is removable, is provided on the inside of the shroud spaced from the first baffle and close to the opening in the inner tube. A motor driven fan is mounted in an opening in the second baffle in position to force useful air through the opening in the inner tube.

The combination of the second baffle and the fan serve to move useful air through the shroud and into the open-ended inner tube which forms the inside wall of the combustion products chamber. Useful air to be heated is drawn into the baffled end of the shroud more or less directly and forced through the inner tube. Additional useful air is also drawn into the open end of the section of the shroud which partially surrounds the outside wall of the exhaust gas chamber and is preheated by transfer of heat through said outside wall. After being diverted by the second baffle, this volume of preheated useful air is entrained by and mixed with the other volume of air being forced directly into the inner tube. Additional heat is thus transferred to this preheated useful air as the latter is moved through the open-ended tube and into the room or space to be heated.

Another feature of the invention is the means for cleaning the residue of the combustion products from the inside walls of the exhaust gas chamber. For convenience and ease of operation the cleaning means comprises a scraper made in two arcuate sections which cooperate to clean the inside walls. Handles connected to the scrapers extend through the end walls of the chamber and are readily accessible for manipulation to remove residue deposited inside the chamber.

DRAWINGS

The invention will be better understood from the following detailed description of a preferred embodiment given as a nonlimiting example with reference to the accompanying drawing, in which:

FIG. 3 is a sectional view along line 3—3 of FIG. 2;

FIG. 4 is a sectional view along line 4—4 of FIG. 3; and

FIG. 5 is a sectional view along line 5—5 of FIG. 3.

PREFERRED EMBODIMENT

Figure 1:
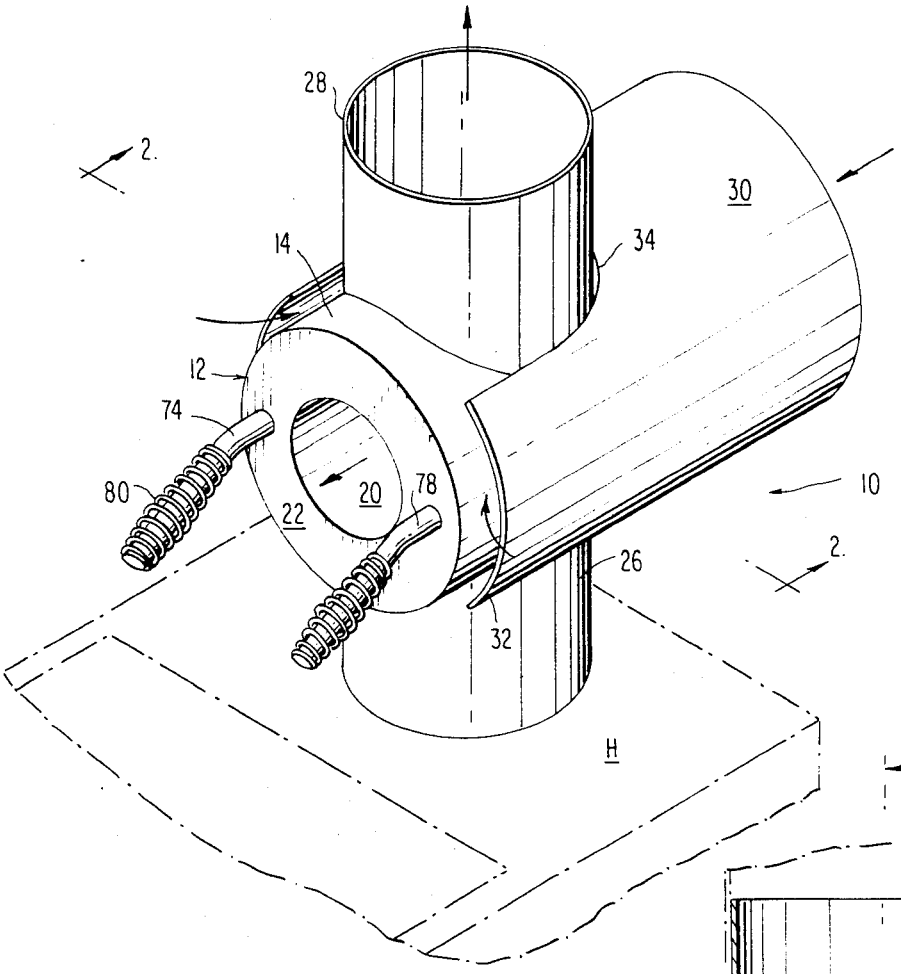
FIG. 1 is a perspective view of the heat saving device in position on an outer wall of a stove, furnace or similar heater, the latter being shown, in part, in dotted lines.
Figure 2:
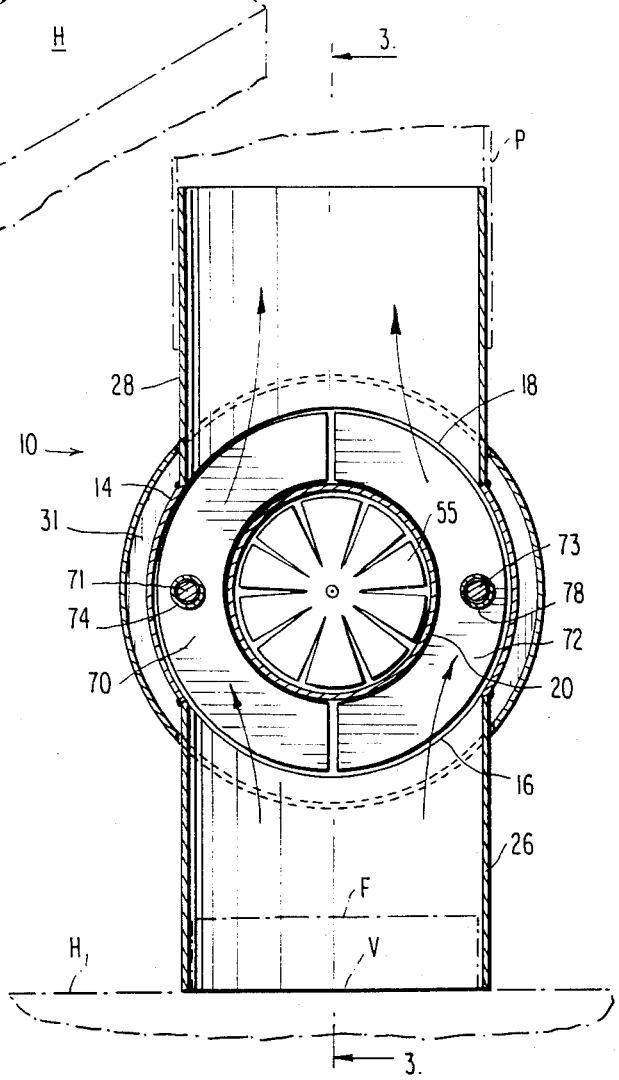
FIG. 2 is a sectional view along line 2—2 of FIG. 1.

The preferred embodiment of the invention is described as it would be used with a free standing stove which is normally constructed of metal plate or sheet metal. Such a stove requires a flue pipe for venting smoke, gases, and other products to the atmosphere. In FIG. 1, the heat saver, generally indicated by reference numeral 10, is shown mounted on an outside wall of a stove H; in this case, the top surface of the stove is shown in dotted lines. FIG. 2 shows an opening V in the top surface provided with an upstanding flange or collar F which would normally receive the flue pipe P (all shown in dotted lines) for venting combustion products directly into the outside air. The heat saving device 10, which may be inserted in the flue pipe at any convenient point is shown in this case mounted directly on the stove's top surface.

The heat saver 10 comprises a chamber 12 through which the combustion products, including smoke and hot exhaust gases, flow in the directions shown generally by arrows in FIGS. 2 and 3. The chamber 12 may be annular in shape and includes an outer wall 14 having oppositely disposed openings 16 and 18. An open-ended inner tube 20 supported by end walls 22 and 24 of chamber 12 forms the inner wall of the chamber.

The hot exhaust gases and other combustion products enter the chamber 12 through opening 16 in one side of the chamber and exit through opening 18 directly opposite the entrance opening after flowing around inner tube 20. A section of pipe or tube 26 is welded at one end to chamber wall 14 and fitted tightly to flange F at its other end, providing for unobstructed flow of exhaust gases from the opening V into the chamber 12. A second pipe section 28 is similarly attached to outer wall 14 at one end and has its other end inserted inside flue pipe P to permit flow from the exit opening 18 into the atmosphere. While not shown, it is assumed that a damper or other flow control device can be provided in flue pipe F.

An open-ended shroud 30, in this case tubular in shape, partially surrounds the outside wall of the exhaust gas chamber 12. As best seen in FIG. 4, the outside diameter of outer chamber wall 14 is substantially smaller than the inside diameter of the shroud 30, providing an annularly shaped space 31 for unobstructed flow of air between the wall 14 and the section of the shroud 30 which surrounds the wall.

Shroud 30, which is removable, has cut-out portions 32 and 34 which slidably receive and closely fit around exhaust gas inlet and outlet pipes 26 and 28, respectively. Fasteners, such as screws 36, inserted through holes in the shroud 30 and into threaded holes in lugs 38 welded to pipes 26 and 28, hold the shroud in position. The shroud 30 extends beyond the end wall 24 of exhaust gas chamber 12 and is provided with first and second baffles 40 and 42, respectively, for controlling and directing the movement of useful air, i.e., air to which heat scavenged from the hot exhaust gases is transferred. First baffle 40 is welded to the shroud and has a central opening 44 for admitting useful air into space or compartment 46. Second baffle 42, also provided with a central opening 48, in line with opening 44 in the first baffle, is removably mounted in the interior of shroud 30 in spaced relationship to first baffle 40, forming the other end of compartment or space 46. Screws 50, inserted through suitable holes spaced around the periphery of shroud 30 and into matching threaded holes in lugs 52 carried on second baffle 42, fasten the latter in place.

An exhaust type fan 55, having appropriate air flow and power ratings, is mounted in opening 48 in second baffle 42. The fan 54 is mounted on baffle 42 by attachment to brackets 56. With this arrangement, useful air will be drawn through opening 44 in first baffle 40 as well as the space 31 between the outer chamber wall 14 and shroud 30, and after mixing in the compartment or space 60 between end wall 24 and baffle 42, will be forced through inner tube 20, as indicated by arrows in FIGS. 1 and 4. In the process, the volume of air flowing through space 31 will be preheated by transfer of heat from the hot exhaust gases through wall 14. After being diverted by baffle 42 and mixed or entrained with the other volume of air entering through openings 44 and 48, the resulting volume of air will receive additional heat as it is forced through inner tube 20 by transfer through the wall of the tube. The useful air with its temperature thus increased is recirculated into the space being heated, adding substantially to the amount of heat provided directly by the stove H.

To maintain the heat exchanging efficiency of the device, a mechanism is provided for removing any residue collecting inside the combustion products chamber 12 comprising complementary arcuate scrapers 70 and 72 positioned inside the chamber and arranged so that each scraper can be slid along the length of the chamber 12 in contact with the inside surfaces of the chamber walls. The scrapers may overlap slightly to ensure that the entire inside surface of both walls is covered. The scrapers are mounted to slide along guiding rods 71 and 73 welded to end wall 24 of chamber 12. Hollow tubular handles 74 and 78, which receive the rods, are attached to the scrapers. The handles pass through openings provided in end wall 22 of chamber 12. Hand grips 80 are provided on the scraper handles.

It can be seen readily that the invention provides a compact, efficient structure for use as a heat saving device. The structure is also such that its parts can be readily made and assembled into a unitary device that is relatively easily installed for operation. In the construction of the device consideration has been given to the types of materials used; for example, a relatively heavy gauge metal may be the most satisfactory from the point of view of absorbing heat from the products of combustion for transfer to useful air. An additional advantage inherent in the structure is the cooling of the outside wall of the combustion products chamber and the flue pipe itself, and the distribution of the heat scavenged to other areas of the space, at some distance from the heater.

I claim:

1. A heat saving device for use in conjuction with the flue pipe of a stove, furnace or similar heater comprising: a chamber carried on said flue pipe including an outer wall having openings for passage of hot combustion products through the chamber, end walls each having an opening, an inner tube supported in the openings in said end walls and forming the inner wall of the chamber, thereby providing for the passage of air through said tube in heat exchanging relationship with the hot combustion products in the chamber, a shroud open at both ends partially surrounding the outer wall of said chamber and being supported in spaced relationship to said wall, said shroud having a section extending beyond one of the end walls of the chamber, a baffle plate provided in the section of the shroud extending beyond the end wall of the hot combustion products chamber, said baffle plate dividing the interior of said shroud into first and second shroud chambers, the first shroud chamber for receiving air directly from outside the shroud and the second shroud chamber for receiving preheated air entering the shroud through the space formed between the shroud and the hot combustion products chamber, said baffle plate having an opening therein in alignment with the inner tube, and a fan mounted in the opening in the baffle plate for causing the air in both shroud chambers to flow through the inner tube in heat exchanging relationship with the hot combustion products.

2. A heat saving device as recited in claim 1, wherein each of the openings in the outer wall of the chamber through which the hot combustion products pass is provided with a sleeve-like pipe section for mating with the flue pipe, and the shroud fits closely around a portion of each pipe section and is supported by being removably attached to the pipe sections.

3. A heat saving device as recited in claim 1 wherein the baffle plate and fan are positioned in said shroud so that air will be directed from said first shroud chamber through the second shroud chamber and into the inner tube thereby mixing with and entraining the preheated air in said second section.

4. A heat saving device as recited in claim 1 with means for cleaning the inside of the hot combustion chamber, said means including a pair of guide rods mounted in said combustion chamber, an arcuate scraper slidably carried on each guide rod in contact with the inside of the walls of the hot combustion chamber, and a handle attached to each of the scrapers, the handles extending through openings provided in an end wall of the combustion chamber.

* * * * *